US011196150B2

(12) United States Patent
Chuang et al.

(10) Patent No.: US 11,196,150 B2
(45) Date of Patent: Dec. 7, 2021

(54) WEARABLE COMMUNICATION DEVICES WITH ANTENNA ARRAYS AND REFLECTIVE WALLS

(71) Applicant: Hewlett-Packard Development Company, L.P., Spring, TX (US)

(72) Inventors: Min-Hsu Chuang, Taipei (TW); Kai-Cheng Chi, Taipei (TW); Chang-Cheng Hsieh, Taipei (TW); Chen-Ta Hung, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/648,732

(22) PCT Filed: Oct. 6, 2017

(86) PCT No.: PCT/US2017/055482
§ 371 (c)(1),
(2) Date: Mar. 19, 2020

(87) PCT Pub. No.: WO2019/070291
PCT Pub. Date: Apr. 11, 2019

(65) Prior Publication Data

US 2020/0274235 A1 Aug. 27, 2020

(51) Int. Cl.
*H01Q 1/24* (2006.01)
*H01Q 1/27* (2006.01)
(Continued)

(52) U.S. Cl.
CPC ..... *H01Q 1/273* (2013.01); *H01Q 1/2258* (2013.01); *H01Q 1/245* (2013.01); *H01Q 3/247* (2013.01); *H01Q 19/18* (2013.01)

(58) Field of Classification Search
CPC . G06F 1/163; G06F 3/011; A61H 2201/1609; H01Q 1/273; H01Q 1/38;
(Continued)

(56) References Cited

U.S. PATENT DOCUMENTS 6,594,370 B1 7/2003 Anderson
7,035,897 B1 4/2006 Devereaux et al.
(Continued)

FOREIGN PATENT DOCUMENTS

DE 60017169 T2 3/2006
WO WO-2016205800 A1 12/2016
WO WO-2017086290 5/2017

OTHER PUBLICATIONS

Abari, O et al, "Cutting the Cord in Virtual Reality", Nov. 9, 2016, 7 pages http://www.mit.edu/%7Eabari/Papers/Hotnets16a.pdf.

*Primary Examiner* — Vibol Tan
(74) *Attorney, Agent, or Firm* — Fabian VanCott

(57) ABSTRACT

In one example in accordance with the present disclosure, a wearable communication device is described. The device includes a housing to be worn by a user and an antenna structure disposed within the housing. The antenna structure includes a substrate, a first antenna array disposed on a first surface of the substrate, and a second antenna array disposed on a second surface of the substrate. The antenna structure also includes a reflective wall facing the second surface.

20 Claims, 7 Drawing Sheets

(51) Int. Cl.
*H01Q 1/22* (2006.01)
*H01Q 19/18* (2006.01)
*H01Q 3/24* (2006.01)

(58) Field of Classification Search
CPC ..... H01Q 21/065; H01Q 13/206; H01Q 15/0013; H01Q 15/14; H01Q 19/10; H01Q 19/108; H01Q 1/243; H01Q 1/42; H01Q 9/065; H01Q 1/245; H01Q 19/18; H01Q 1/521
See application file for complete search history.

(56) References Cited

U.S. PATENT DOCUMENTS

| | | | | |
|---|---|---|---|---|
| 7,443,345 | B2 * | 10/2008 | Zhang | H01Q 1/246 343/700 MS |
| 9,160,064 | B2 | 10/2015 | Ferguson | |
| 9,547,335 | B1 * | 1/2017 | Bevelacqua | G06F 3/011 |
| 9,586,318 | B2 * | 3/2017 | Djugash | G06F 1/163 |
| 10,360,907 | B2 * | 7/2019 | Dayal | H04M 1/05 |
| 2006/0262027 | A1 | 11/2006 | Zhang | |
| 2008/0311944 | A1 | 12/2008 | Hansen et al. | |
| 2014/0070957 | A1 | 3/2014 | Longinotti-Buitoni et al. | |
| 2015/0356781 | A1 | 12/2015 | Miller | |
| 2016/0005233 | A1 | 1/2016 | Fraccaroli et al. | |
| 2016/0250752 | A1 | 9/2016 | Djugash | |
| 2018/0323508 | A1 * | 11/2018 | Chigusa | H01Q 3/247 |

* cited by examiner

WEARABLE COMMUNICATION DEVICES WITH ANTENNA ARRAYS AND REFLECTIVE WALLS

BACKGROUND

Virtual reality applications allow a user to become immersed in a virtual environment. For example, a head-mounted display, using stereoscopic display devices, allow a user to see, and become immersed into any desired virtual scene. Such virtual reality applications also provide visual stimuli, auditory stimuli, and can track user movement to create a rich immersive experience.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
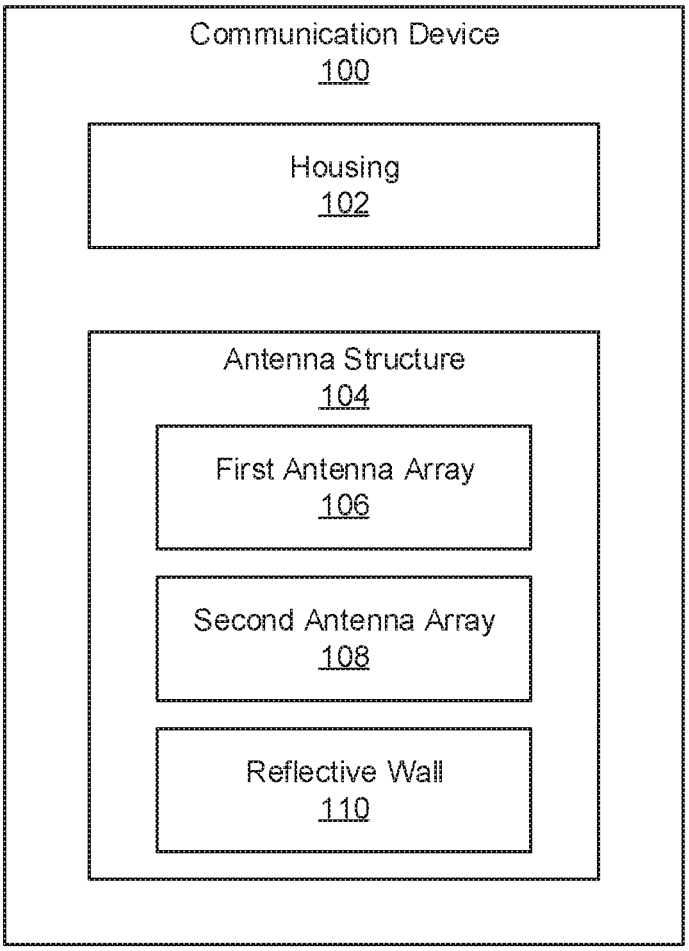
FIG. 1 is a block diagram of a wearable communication device with antenna arrays and reflective walls, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Virtual reality applications allow a user to become immersed in a virtual environment. For example, a head-mounted display, using stereoscopic display devices, allows a user to see and become immersed into any desired virtual scene. Such virtual reality applications also provide visual stimuli, auditory stimuli, and can track user movement to create a rich immersive experience. In some examples, user input devices are incorporated into a virtual reality system. For example, handles that have various gyroscopes and buttons detect user movement and other user input and manipulate the virtual environment accordingly. As such, users can use input devices to interact with the virtual scene. As one particular example, haptic gloves allow a user to grab objects in the virtual scene.

While such virtual reality devices have undoubtedly provided a valuable tool in many industries as well as a source of diversion for users. Some characteristics impede their more complete implementation. For example, large amounts of data are transferred between a computing device that generates the virtual scene and the virtual reality device that includes the headset. In some examples, the base stations are mounted on virtual reality devices that are worn by a user, for example on their head. However, these base stations can be bulky and make movements of the user awkward.

Accordingly, in some cases the data is transferred via a physical cable tethered between the virtual reality device and the base station. Such a physical cable restricts the unimpeded movement of the user as they are limited in their movement by the dimensions of the physical cable.

Wireless solutions exist; however, they too are prone to complications. For example, such virtual reality systems transmit large volumes of data, i.e., video and audio data at a high rate. This will be more relevant as video resolutions and refresh rates are increased over time. To accommodate high transfer rates of large amounts of data, a wireless transmission protocol is used which facilitates data transmission at high frequencies, such as 60 Gigahertz (GHz). However, transmissions at these frequencies are prone to being blocked by physical obstacles. For example, if a user's body, or a portion of the user's body, is disposed in the direct path between a base station and the virtual reality device antenna, a signal may be lost, which would result in lags in virtual data transmission, or a complete lack of transmission of virtual data.

Accordingly, the present specification describes an example communication device that facilitates increased data transmission with less likelihood for signal interruption. Specifically, the communication device includes a housing. The housing is to be worn by a user, for example around the neck. Antenna structures having arrays on both sides allow data transmission in two directions relative to the antenna structure. A reflecting wall in the housing ensures that all data transmissions are in the same general direction. Moreover, in some cases multiple of these antenna structures are disposed within a housing. One antenna structure to be disposed on a front side when worn by a user and another to be disposed on a rear side when worn by a user. These dual-sided antenna arrays placed on opposite sides of the housing in this fashion increase the data transmission between the wearable device and the base station, thus resulting in 1) greater data transfer, thus accommodating a higher bandwidth, and 2) a reduced likelihood of data interruption.

Specifically, the present specification describes an example communication device. The communication device includes a housing to be worn by a user. An antenna structure is disposed within the housing. The antenna structure includes a substrate, a first antenna array disposed on a first surface of the substrate, and a second antenna array disposed on a second surface of the substrate. The antenna structure also includes a reflective wall facing the second surface.

In another example, the communication device includes a housing to be worn by a user and at least two antenna structures disposed within the housing. Each antenna structure includes a substrate, a first antenna array disposed on a first surface of the substrate, a second antenna array disposed on a second surface of the substrate, and a reflective wall facing the second surface. In this example, a first antenna structure and a second antenna structure are disposed on opposite sides of the housing.

The present specification also describes an example virtual reality system. The virtual reality system includes a base station to communicate with a wearable virtual reality device. The wearable virtual reality device includes a housing to be worn around a neck of a user and at least two antenna structures to transmit and receive signals. The at least two antenna array structures are disposed within the housing and each include a substrate, a first antenna array disposed on a first surface of the substrate, and a second antenna array disposed on a second surface of the substrate. The wearable virtual reality device also includes a reflective wall facing the second surface to 1) direct received signals onto the second antenna array and 2) direct transmitted signals from the second antenna array to travel in substantially the same direction as transmitted signals from the first antenna array.

In summary, using such a communication device and system 1) provides for effective transmission of large amounts of data at high data rates; 2) facilitates unimpeded and comfortable movement of the user while wearing the virtual reality device; and 3) reduces the likelihood of data transmission interruptions. However, it is contemplated that the devices disclosed herein may address other matters and deficiencies in a number of technical areas.

As used in the present specification and in the appended claims, the term "a number of" or similar language is meant to be understood broadly as any positive number including 1 to infinity.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

FIG. 1 is a block diagram of a wearable communication device (100) with antenna arrays (106, 108) and a reflective wall (110), according to an example of the principles described herein. In this example, the communication device (100) communicates with a base station to generate a virtual environment for a user. For example, a base station sends data signals which create the virtual environment. The communication device (100) receives these signals and passes them to a visual interface which creates the virtual environment. Signals can also be passed to an audio interface to create a soundscape for the virtual environment. The communication device (100) may be coupled to input devices such as gyros in a virtual reality device or other input devices such as hand controllers. The communication device (100) relays these signals back to a base station to be translated into movements and allow interaction with the virtual environment.

Figure 4:
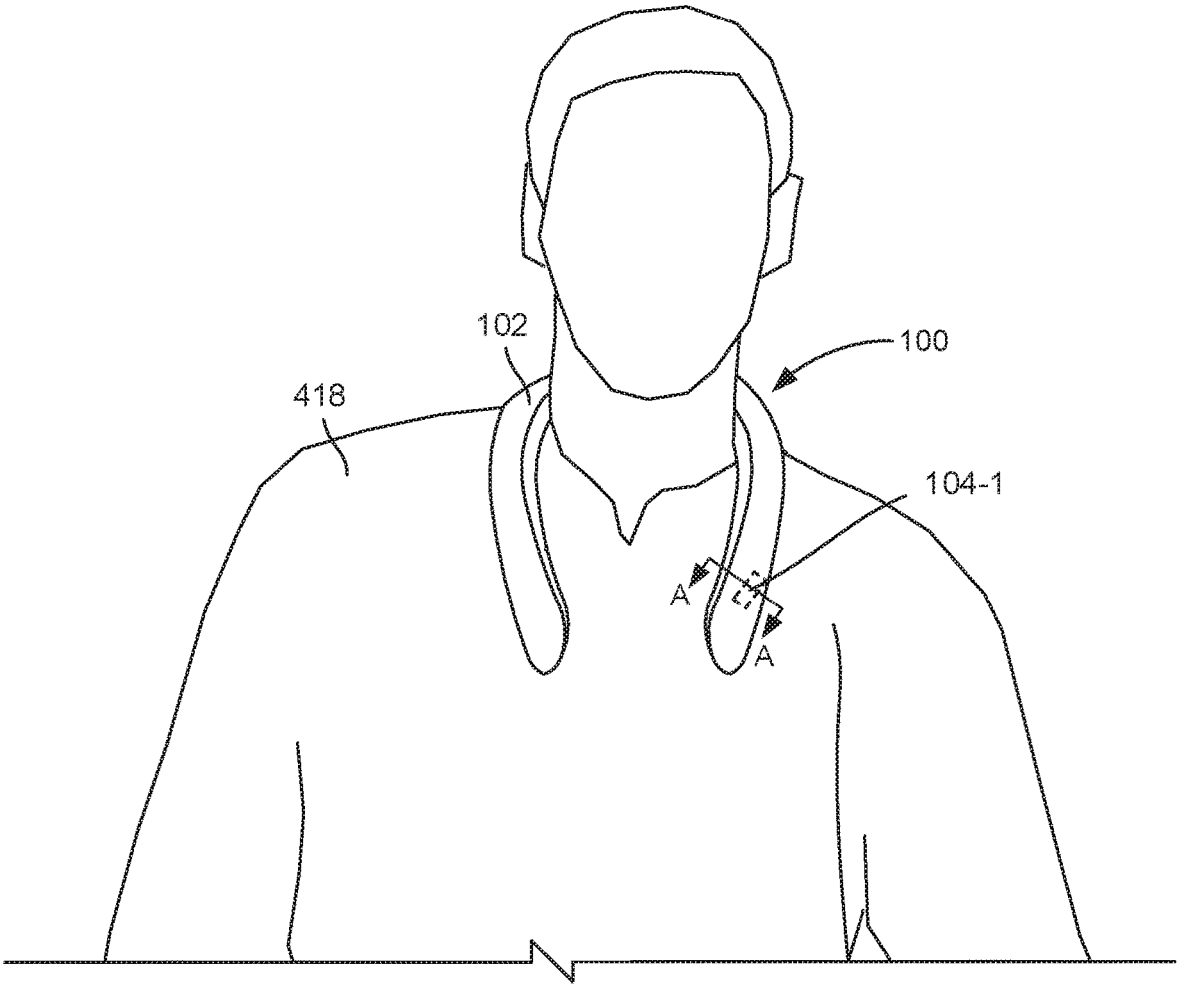
FIG. 4 is a diagram of a wearable communication device with antenna arrays and reflective walls as worn by a user, according to an example of the principles described herein, according to an example of the principles described herein.

The communication device (100) includes a housing (102) to be worn by the user. An example of a housing (102) as worn by a user is depicted in FIG. 4. The housing (102) may be formed of any material, such as plastic, and may have other surfaces, such as rubber, that are more comfortable against a user's skin. The housing (102) may be adjustable such that it can accommodate various shapes and sizes of users. The housing (102) may be hollow such that it contains certain components. For example, an antenna structure (104) is disposed within the housing (102). The antenna structure (104) communicates with the base station. That is the antenna structure (104) receives data signals from, and transmits signals to, the base station.

The antenna structure (104) may be small, for example a 19 by 7 millimeter (mm) rectangle that is 2.5 mm thick. An example of the size and configuration of the antenna structure (104) is provided in FIG. 3. The antenna structure (104) includes a substrate with multiple antenna arrays (106, 108) formed thereon. Specifically, a first antenna array (106) is disposed on a first surface of the substrate and a second antenna array (108) is disposed on a second surface of the substrate, which second surface is opposite the first surface. That is, the first antenna array (106) and the second antenna array (108) are facing away from one another.

The antenna structure (104) also includes a reflective wall (110) facing the second surface. This reflective wall (110) directs received signals onto the second antenna array (108) and directs transmitted signals from the second antenna array (108) to travel in substantially the same direction as transmitted signals from the first antenna array (108). Such a dual-sided antenna structure (104) and reflective wall (110) increases the data transmission as array elements on both sides of the array structure (104) can receive and send data signals. The dual-sided antenna structure (104) also reduces data interruption as array elements on the second surface can allow signal transmission when the first surface may be blocked.

Figure 2:
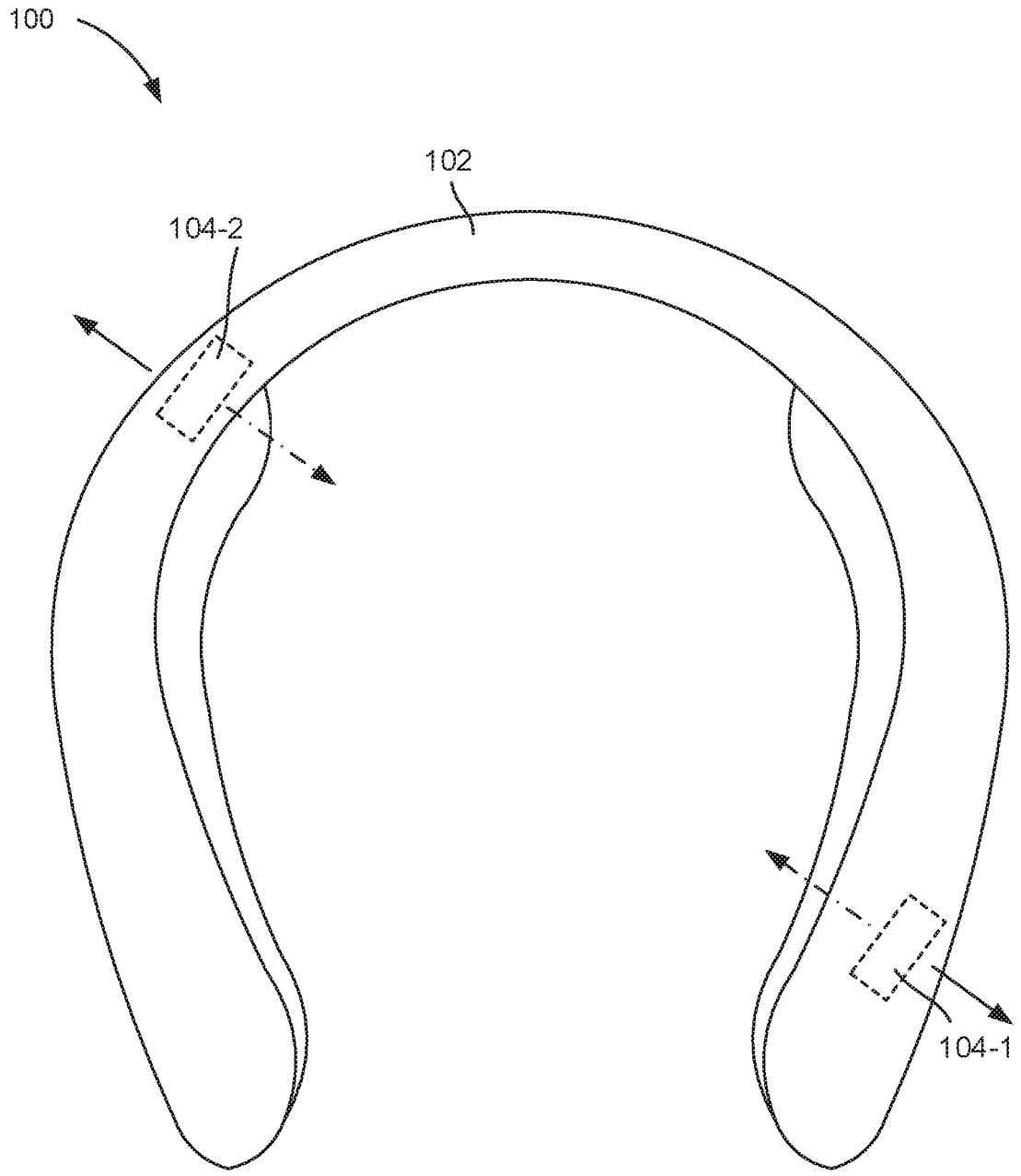
FIG. 2 is a diagram of a wearable communication device with antenna arrays and reflective walls, according to an example of the principles described herein.

FIG. 2 is a diagram of a wearable communication device (100) with antenna arrays (FIG. 1, 106, 108) and reflective walls (FIG. 1, 110), according to an example of the principles described herein. As described above, the communication device (100) includes a housing (102) that is to be worn by a user. For example, the housing (102) may be a U-shaped housing (102) to be worn around a neck of the user.

In this example, the communication device (100) includes two antenna structures (104-1, 104-2) disposed within the housing (102). The antenna structures (104-1, 104-2) are depicted in dashed line to indicate their location internal to the housing (102). Each of the antenna structures (104-1, 104-2) include a first antenna array (FIG. 1, 106) and a second antenna array (FIG. 1, 108). That is, the first antenna structure (104-1) has a first antenna array (FIG. 1, 106) and a second antenna array (FIG. 1, 108) and the second antenna structure (104-2) has a first antenna array (FIG. 1, 106) and a second antenna array (FIG. 1, 108).

The second antenna arrays (FIG. 1, 108) may be pointed towards one another. That is, the second antenna array (FIG. 1, 108) of the first antenna structure (104-1) and the second antenna array (FIG. 1, 108) of the second antenna structure (104-2) may be pointed towards one as indicated by the dashed-dot arrows. However, in these examples, the corresponding reflective walls (FIG. 1, 110) reflect transmitted signals away from the user.

The first antenna arrays (FIG. 1, 106) may be pointed away from one another. That is, the first antenna array (FIG. 1, 106) of the first antenna structure (104-1) and the first antenna array (FIG. 1, 106) of the second antenna structure (104-2) may be pointed away from one another as indicated by the solid arrows.

In some examples, the antenna structures (104) are disposed on opposite sides of the housing (102). Specifically, as is depicted in FIG. 4, one antenna structure (104-1) is to be disposed on a front of the user when worn, and the other antenna structure (104-2) is to be disposed on a back of the user when worn. Doing so decreases the likelihood of signal interruption. For example, as a user moves, and the front antenna structure (104-1) becomes blocked, the back antenna structure (104-2) would be available to transmit and receive data signals. In other words, each antenna structure (104) has a 180 degree range such that the antenna structures (104) together have a 360 degree range.

The two antenna structures (104) may interoperate such that when one is active, the other is deactivated. That is, when the first antenna structure (104-1) is active, the second antenna structure (104-2) is deactivated. Similarly, when the second antenna structure (104-2) is active, the first antenna structure (104-1) is deactivated. Accordingly, each antenna structure (104) may include signal processing and monitoring components such that each antenna structure (104) can determine its own signal strength and if signal strength drops below a threshold value, or below a signal strength of the other antenna structure (104), it deactivates in favor of the other antenna structure (104). For example, when the signal strength of the first antenna structure (104-1) drops below a certain level, for example due to a blockage by a user's body, the first antenna structure (104-1) deactivates and the second antenna structure (104-2) activates. Doing so conserves power as an antenna structure (104) that has reduced operating efficiency is powered down, while that antenna structure (104) transmitting more efficiently is powered.

While FIG. 2 depicts a particular number of antenna structures (104) disposed in particular locations within the housing (102), any number of antenna structures (104) may be disposed within the housing (102) at any location.

Figure 3A:
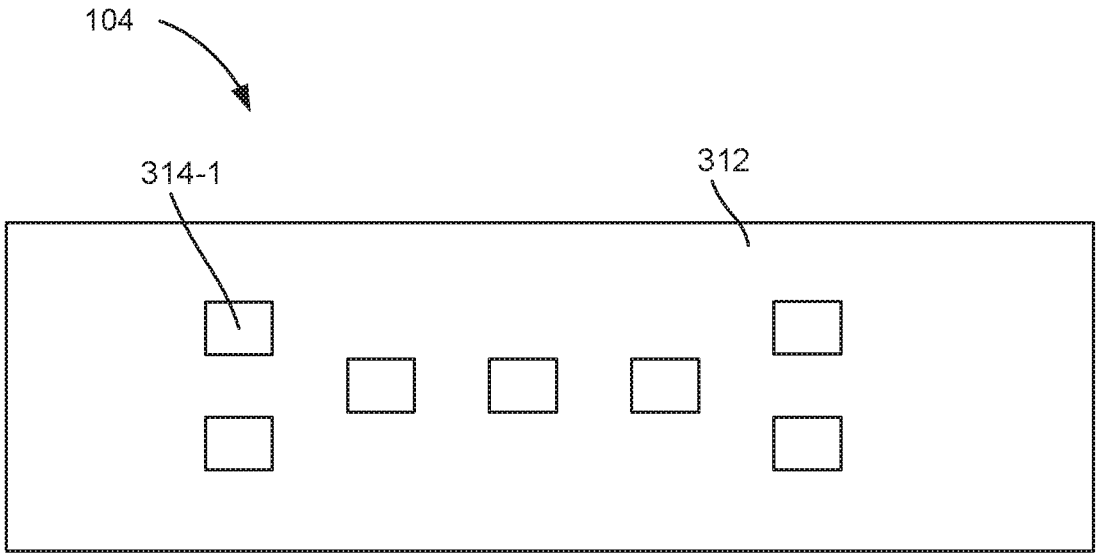
FIGS. 3A and 3B are diagrams of an antenna structure, according to an example of the principles described herein.
Figure 3B:
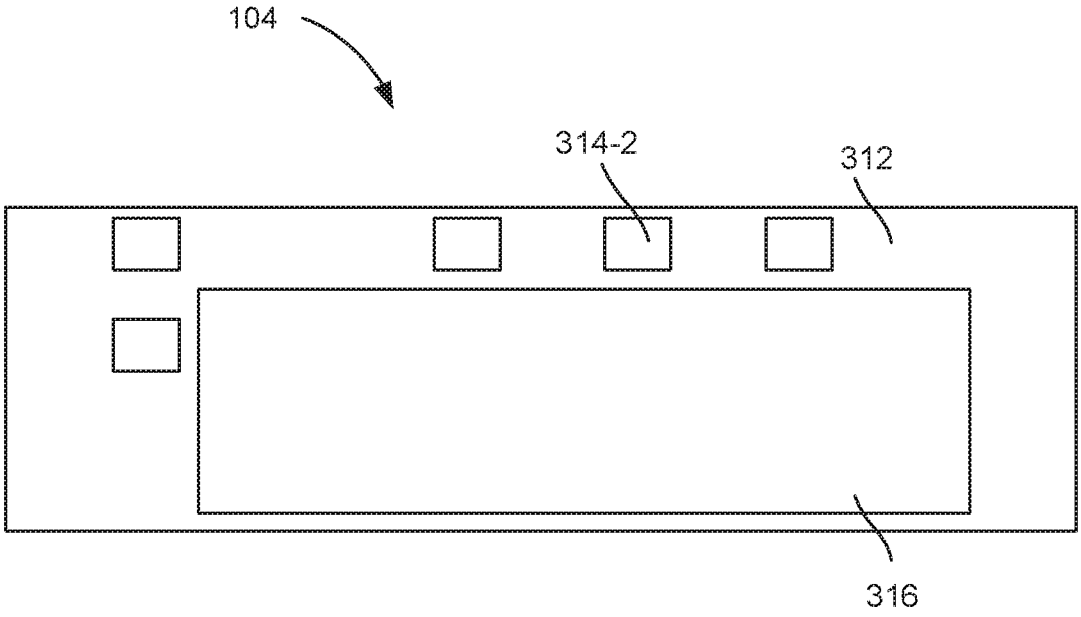

FIGS. 3A and 3B are diagrams of an antenna structure (104), according to an example of the principles described herein. Specifically, FIG. 3A is a view of a front surface of the substrate (312) of the antenna structure (104) on which a first antenna array (FIG. 1, 106) is disposed and FIG. 3B is a view of a back surface of the substrate (312) of the antenna structure (104) on which a second antenna array (FIG. 1, 108) is disposed.

Each of the antenna arrays (FIG. 1, 106, 108) is made up of various array elements (314-1, 314-2). For simplicity, in FIGS. 3A and 3B, a few array elements (314) are indicated with reference numbers. Moreover, while FIGS. 3A and 3B indicate a certain number of array elements (314) in a particular pattern, any number of array elements (314) in any pattern may be implemented in the array structures (104). As depicted in FIGS. 3A and 3B, array elements (314) are found on opposite surfaces of the array structures (104) such that data signals can be transmitted and received from multiple sides, thus increasing data transmission bandwidth and data transmission rates, as well as decreasing data transmission interruptions.

As described above, in some settings, such as virtual reality systems, large amounts of data are transmitted back and forth. Accordingly, the first and second antenna arrays (FIG. 1, 106, 108), that is their respective antenna elements (314), receive and transmit 60 GHz signals. However, other frequencies of signals such as terahertz signals may also be received. Different types of signals may also be transmitted such as infrared and light signals.

In some examples, at least one of the surfaces may include a signal processing component (316). The signal processing component (316) may perform any number of control operations over the arrays (FIG. 1, 106, 108) on the antenna structure (104). For example, the signal processing component (316) may filter and scale the signal. As another example, the signal processing component (316) may, as described above, switch off the antenna structure (104) in favor of another antenna structure (104) that has a stronger signal.

FIG. 4 is a diagram of a wearable communication device (100) with antenna arrays (FIG. 1, 106) and reflective walls (FIG. 1, 110) as worn by a user (418), according to an example of the principles described herein. As described above, the housing (102) may be U-shaped to be worn around a neck of the user (418). Also as described above, each of the antenna structures (104) are positioned on opposite sides of the housing (102). Specifically, a first antenna structure (FIG. 1, 104-1) is positioned to be on a front of the user (418) when worn, and the second antenna structure (104-2) is positioned to be on a back of the user (418) when worn.

Moreover, as described above, the housing (102) may include some surfaces that are soft, for example those surfaces that contact the user's (418) skin, so as to be comfortable during use. The housing (102) may be sized to fit comfortably around the neck of a user (418). For example, the housing (102) may have an outside diameter of 36 millimeters. The housing (102) may also be designed to be lightweight. For example, the housing (102) may be formed out of a lightweight plastic and may have a thickness of 2 mm.

Figure 5:
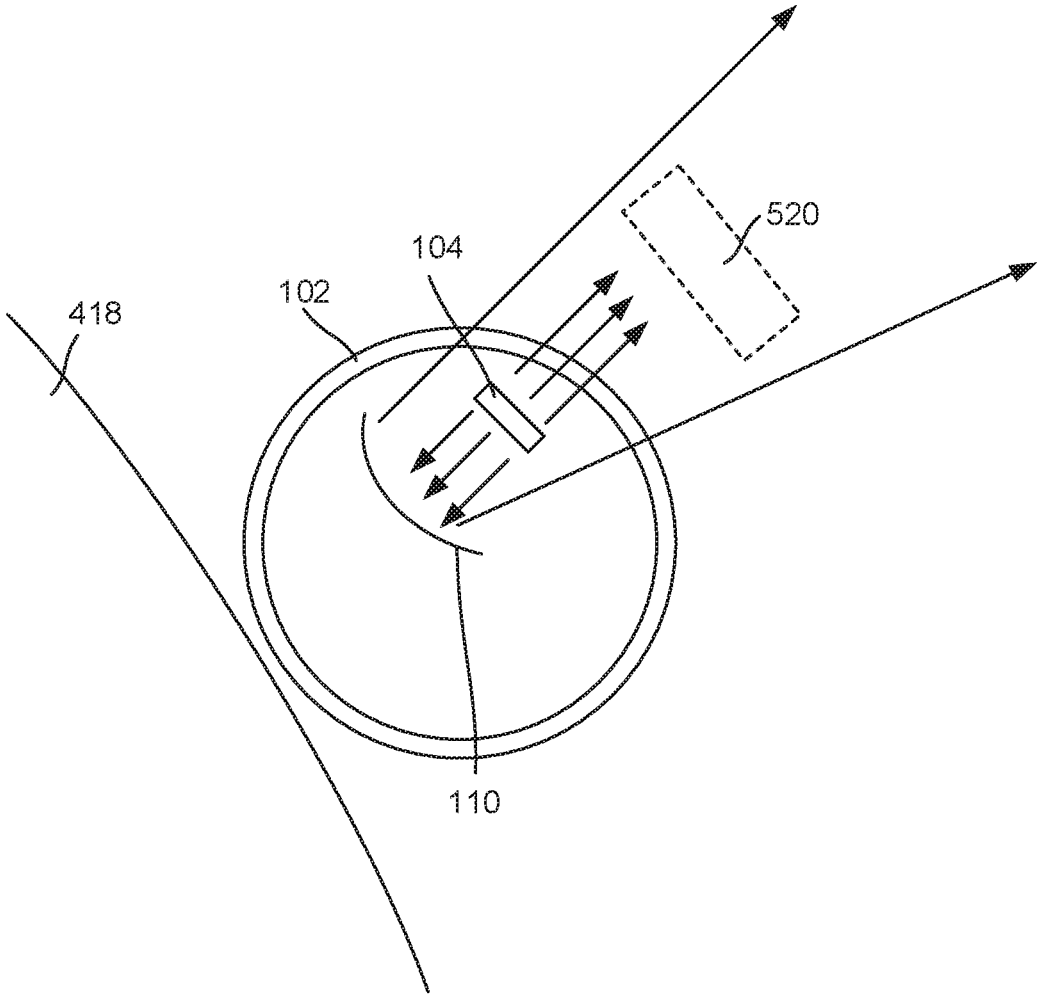
FIG. 5 is a cross-section view of a wearable communication device with antenna arrays and reflective walls, according to an example of the principles described herein.

FIG. 5 is a cross-section view of a wearable communication device (FIG. 1, 100) with antenna arrays (FIG. 1, 106, 108) and reflective walls (110), according to an example of the principles described herein. Specifically, FIG. 5 is a cross-sectional view taken along the line A-A in FIG. 4. FIG. 5 clearly depicts the hollow housing (102). FIG. 5 also depicts the antenna structure (104) with a first antenna array (FIG. 1, 106) facing away from the user (418) and a second antenna array (FIG. 1, 108) facing towards the user (418).

However, as described above, the housing (102) also includes a reflective wall (110). The reflective wall (110) carries out a number of functions. First, the reflective wall (110) protects the user (418) from energy absorption. That is, radio frequency signals, such as those used in virtual reality systems, create electromagnetic fields, which generate energy that can be absorbed into the body. The reflective wall (110), by reflecting received and transmitted signals away from the user (418) body, shield the body from these emissions and any potentially harmful effects that may result therefrom.

As another example, the reflective wall (110) enhances the communication mode between the communication device (FIG. 1, 100) and the base station. For example, in some cases an object (520) such as a user's hand, may block the transmission path between the first antenna array (FIG. 1, 106) and the base station. However, the reflective wall (110) which may be curved, can reflect transmitted signals from the second antenna array (FIG. 1, 108) at an angle, but in substantially the same direction as the signals from the first antenna array (FIG. 1, 106) to go around the object (520). Thus, signals that otherwise would not reach the base station can reach the base station and thereby carry information due to the effects of a curved reflective wall (110). In other words, without the reflective wall (110), radiation from the second antenna array (FIG. 1,108) may be absorbed by the user (418) body and radiation from the first antenna array (FIG. 1, 106) may be more likely to be blocked by an obstacle (520) in the transmission path. Accordingly, the reflective wall (110) 1) decreases body absorption of the carrier waves and 2) increases data transmission efficiency.

In some examples, the reflective wall (110) may be a metallic piece of sheet material that is bent into form, or it may be a reflective coating disposed over a plastic piece of sheet material. While specific reference is made to particular forms of the reflective wall (110), the reflective wall (110) may be of a variety of forms.

Figure 6:
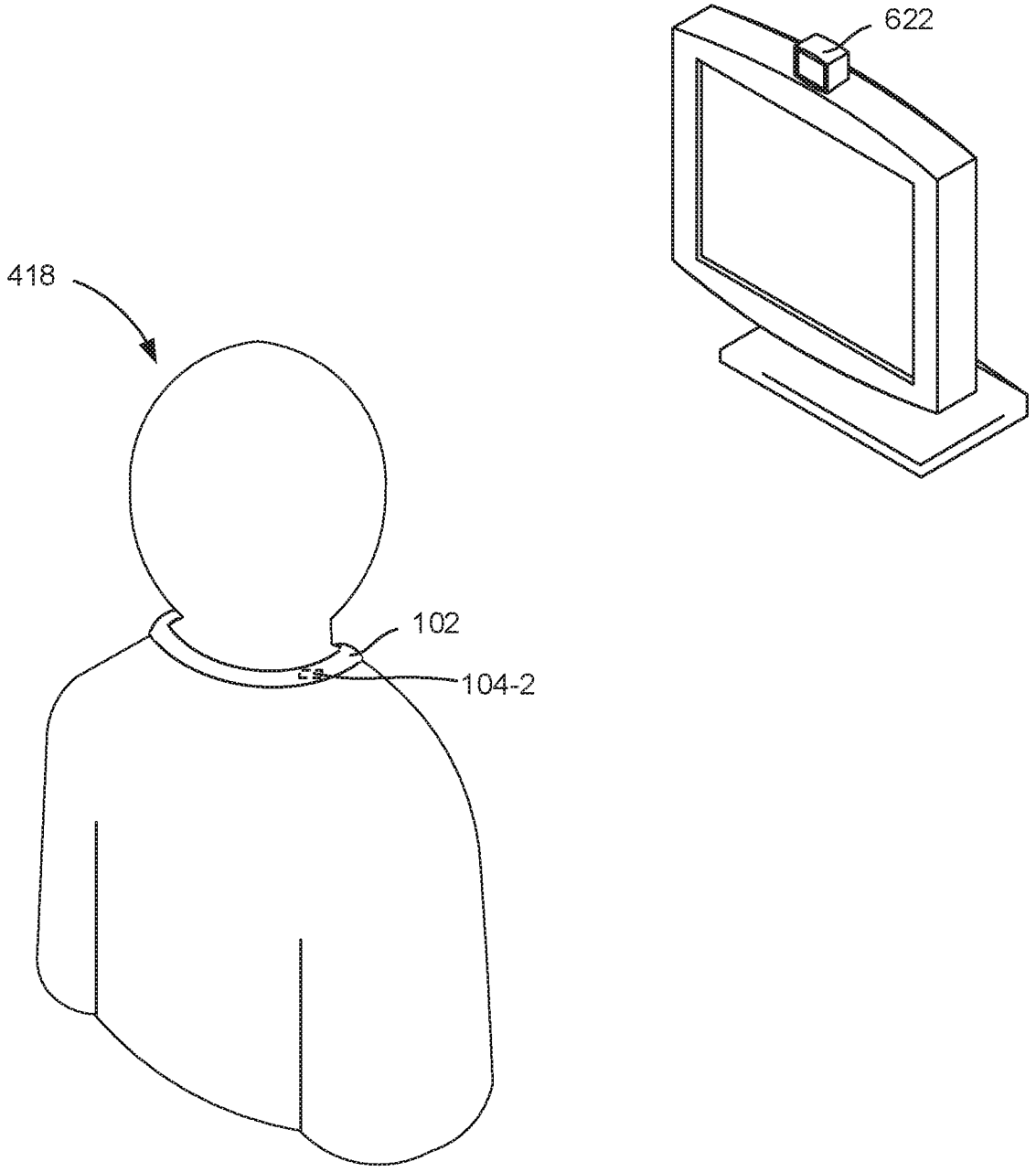
FIG. 6 is a diagram of a user engaging with a virtual reality system including a wearable communication device with antenna arrays and reflective walls, according to an example of the principles described herein.

FIG. 6 is a diagram of a user (418) engaging with a virtual reality system including a wearable communication device (FIG. 1, 100) with antenna arrays (FIG. 1, 106, 108) and reflective walls (FIG. 1, 110), according to an example of the principles described herein. The system includes the wearable communication device (FIG. 1, 100) which device includes the housing (102) and the antenna structures (FIG. 1, 104) disposed therein. The system also includes a base station (622) that may be a distance from the user (418). The base station (622) communicates with the wearable virtual reality device, which wearable virtual reality device includes the communication device (FIG. 1, 100). The base station (622) may be the source of the virtual environment that is created and facilitates, based on information received from the wearable virtual reality device, the user (418) interaction with the environment. That is, sensors in the wearable virtual device, which sensors include gyroscopes, movement sensors, and other types of input sensors, generate data, which is passed to the base station (622) via the communication device (FIG. 1, 100). This data is then used by the base station (622) to replicate digital displays commensurate with the detected movement by the sensors and other input devices.

Figure 7:
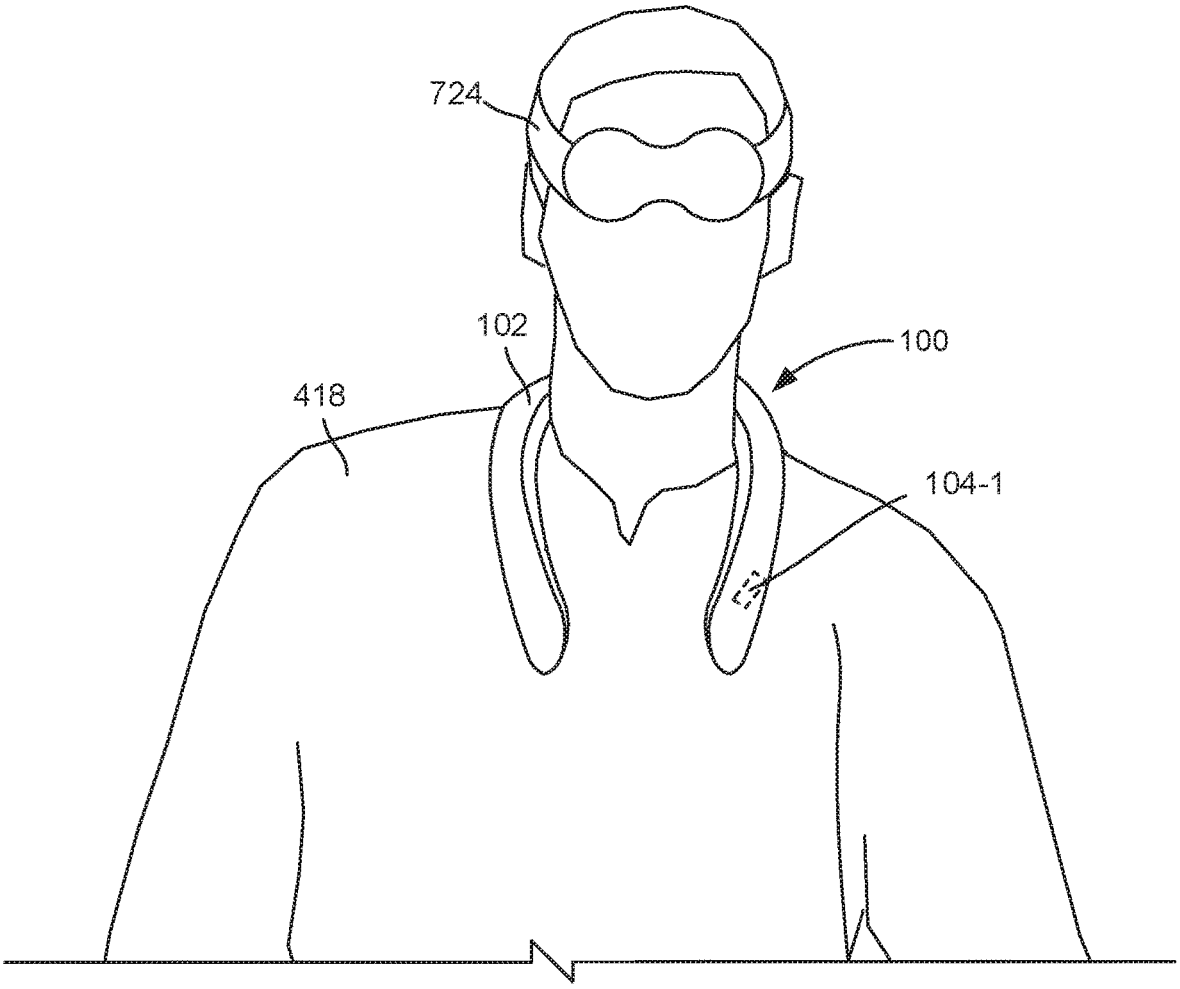
FIG. 7 is a diagram of a user wearing a wearable virtual reality device, according to an example of the principles described herein.

FIG. 7 is a diagram of a user wearing a wearable virtual reality device, according to an example of the principles described herein. As described above, the virtual reality device includes the wearable communication device (100) with its housing (102) and antenna structures (104) that facilitate data transmission. The virtual reality device also includes a visual interface (724). The visual interface (724) generates the visual display portion of the virtual reality. In some examples, the visual interface (724) comprises virtual reality goggles that are worn by the user (418). These virtual reality goggles may include stereoscopic displays that add dimension to the displayed reality. The virtual reality device may also include an audio interface that provides a soundscape for the virtual reality environment that is created.

In summary, using such a communication device and system 1) provides for effective transmission of large amounts of data at high data rates; 2) facilitates unimpeded, and comfortable movement of the user while wearing the virtual reality device; and 3) reduces the likelihood of data transmission interruptions. However, it is contemplated that the devices disclosed herein may address other matters and deficiencies in a number of technical areas.

The preceding description has been presented to illustrate and describe examples of the principles described. This description is not intended to be exhaustive or to limit these principles to any precise form disclosed. Many modifications and variations are possible in light of the above teaching.

What is claimed is:

1. A communication device comprising:
a housing to be worn by a user; and
an antenna structure disposed within the housing, which antenna structure comprises:
a substrate;
a first antenna array disposed on a first surface of the substrate;
a second antenna array disposed on a second surface of the substrate; and
a reflective wall facing the second surface, wherein data transmissions from the first antenna array and the second antenna array are directed in a same direction away from the user.

2. The communication device of claim 1, wherein the housing is to be worn around a neck of the user.

3. The communication device of claim 1, wherein the housing is a U-shaped housing.

4. The communication device of claim 1, wherein the antenna structure further comprises a signal processing component to control antenna array elements.

5. The communication device of claim 1, wherein the first and second antenna arrays in the antenna structure receive and transmit 60 gigahertz (GHz) frequency signals.

6. A communication device comprising:
a housing to be worn by a user;
at least two antenna structures disposed within the housing, each antenna structure comprising:
a substrate;
a first antenna array disposed on a first surface of the substrate;
a second antenna array disposed on a second surface of the substrate; and
a reflective wall facing the second surface, wherein data transmissions from the first antenna array and the second antenna array are directed in a same direction away from the user;
wherein the at least two antenna structures comprise a first antenna structure and a second antenna structure that are disposed on opposite sides of the housing;
data transmissions from the first antenna structure are directed in a first direction away from the user; and
data transmissions from the second antenna structure are directed in a second direction away from the user.

7. The communication system of claim 6, wherein:
the first antenna structure is disposed within a front side of a U-shaped housing to be located on a front of the user; and
the second antenna structure is disposed within a rear side of the U-shaped housing to be located on a back of the user.

8. The communication system of claim 6, wherein the first antenna array of the first antenna structure and the first antenna array of the second antenna structure are pointed away from one another.

9. The communication system of claim 6, wherein:
the second antenna array of the first antenna structure and the second antenna array of the second antenna structure are pointed towards one another; and
each reflective wall reflects signals emanating from the corresponding second antenna array away from the user.

10. The communication system of claim 6, wherein:
when the first antenna structure is active, the second antenna structure is inactivated; and
when the first antenna structure is inactive, the second antenna structure is activated.

11. A virtual reality system comprising:
a base station to communicate with a wearable communication device; and
the wearable communication device comprising:
a housing to be worn around a neck of a user;
at least two antenna structures to transmit and receive signals, wherein the at least two antenna structures are disposed within the housing, each antenna structure comprising:
a substrate;
a first antenna array disposed on a first surface of the substrate;
a second antenna array disposed on a second surface of the substrate; and a reflective wall facing the second surface to:

direct received signals onto the second antenna array; and direct transmitted signals from the second antenna array to travel in substantially the same direction as transmitted signals from the first antenna array away from the user, wherein signals from a first antenna structure are directed in a first direction away from the user and signals from a second antenna structure are directed in a second direction away from the user.

12. The virtual reality system of claim 11, wherein the virtual reality system further comprises a visual interface.

13. The virtual reality system of claim 12, wherein the visual interface comprises virtual reality goggles worn by a user.

14. The virtual reality system of claim 11, further comprising an audio interface.

15. The virtual reality system of claim 11, wherein:

the at least two antenna structures comprise a first antenna structure and a second antenna structure that are disposed on opposite sides of the housing;

each antenna structure has a 180-degree range; and the antenna structures together have a 360-degree range.

16. The communication device of claim 1, wherein the reflective wall is curved.

17. The communication device of claim 4, wherein the signal processing component is disposed on the substrate.

18. The communication system of claim 6, wherein a signal processing component of the first antenna structure is to deactivate the first antenna structure when a signal strength of the first antenna structure drops below a threshold value.

19. The communication system of claim 6, wherein a signal processing component of the first antenna structure is to deactivate the first antenna structure when a signal strength of the first antenna structure drops below a signal strength of the second antenna structure.

20. The communication system of claim 6, wherein a signal processing component of the first antenna structure is to deactivate the first antenna structure responsive to a detected blockage of the first antenna structure.

* * * * *